United States Patent [19]

Pischinger et al.

[11] Patent Number: 4,563,982

[45] Date of Patent: Jan. 14, 1986

[54] METHOD AND APPARATUS FOR INTRODUCTION OF A FLUID MEDIUM INTO WORKING SPACE OF AN INTERNAL COMBUSTION ENGINE

[75] Inventors: Franz Pischinger, Aachen, Fed. Rep. of Germany; Robert Söllner, Jenbach, Austria

[73] Assignee: Forschungsgesellschaft für Energietechnik und Verbrennungsmotoren mbH, Aachen, Fed. Rep. of Germany

[21] Appl. No.: 588,522

[22] Filed: Mar. 12, 1984

[30] Foreign Application Priority Data

Mar. 12, 1983 [DE] Fed. Rep. of Germany ..... 3308886
Jan. 14, 1984 [DE] Fed. Rep. of Germany ..... 3401143

[51] Int. Cl.[4] ..... F02B 75/12

[52] U.S. Cl. ..... 123/1 A; 123/25 A; 123/25 R; 123/525

[58] Field of Search ..... 123/1 A, 25 E, 527, 123/25 R, 25 A, DIG. 12, 525

[56] References Cited

U.S. PATENT DOCUMENTS

| | | | |
|---|---|---|---|
| 724,763 | 4/1903 | Wallmann | 123/25 E |
| 807,338 | 12/1905 | Turenne | 123/25 E |
| 898,512 | 9/1908 | Schreber | 123/25 E |
| 1,085,233 | 1/1914 | Ahlberg | 123/25 E |
| 1,155,709 | 10/1915 | Gaston et al. | 123/25 E |
| 1,279,367 | 9/1918 | Lake | 123/25 E |
| 1,371,225 | 3/1921 | Crossen | 123/25 E |
| 3,983,882 | 10/1976 | Billings | 123/DIG. 12 |
| 4,191,141 | 3/1980 | Franke | 123/25 E |
| 4,385,593 | 5/1983 | Brooks | 123/25 E |

FOREIGN PATENT DOCUMENTS

| | | | |
|---|---|---|---|
| 1958732 | 11/1968 | Fed. Rep. of Germany | 123/25 E |
| 2550722 | 5/1977 | Fed. Rep. of Germany | 123/25 E |
| 2060058 | 4/1981 | United Kingdom | 123/1 A |

*Primary Examiner*—E. Rollins Cross
*Attorney, Agent, or Firm*—Becker & Becker, Inc.

[57] ABSTRACT

A method and apparatus for introduction of a fluid or liquid medium into the working or operating chamber of an internal combustion engine is disclosed. For the purpose and object of reduction of nitric oxide emission as well as for an improvement of the efficiency there is proposed with a method and apparatus for introduction of the fluid or liquid medium into the working or operating chamber of an internal combustion engine operated with gaseous fuels to admix the fluid continuously or intermittently as to the gaseous fuel and subsequently to blow-in the fuel or power gas/fluid or liquid mixture into the working or operating chamber of the internal combustion engine under the pressure of the fuel or power gas. Hereby there can be utilized or employed advantageously besides the water also alcohol and alcohol/water mixtures, which means media with bound OH-groups.

16 Claims, 2 Drawing Figures

METHOD AND APPARATUS FOR INTRODUCTION OF A FLUID MEDIUM INTO WORKING SPACE OF AN INTERNAL COMBUSTION ENGINE

The present invention relates to a method and an apparatus for introduction of a fluid or liquid medium into the working space or operating chamber of an internal combustion engine operated with gaseous fuels. The present invention is employable corresponding to the terms of DIN 1940 (German Industrial Norm) not only with a spark-ignition engine or Otto internal reciprocating combustion engine but also with Diesel-gas-motors or engines and pilot-injection-gas or ignition-ray-gas engines.

BACKGROUND OF THE INVENTION

1. Field of the Invention

A known goal or object of the introduction of fluids or liquids, especially of water, into the combustion chamber of engines operated with fluid or liquid fuels, is to reduce the nitrogen oxide or nitric oxide concentration in the exhaust gas by lowering of the process temperature level. The knock inclination or tendency with employment of fuels of nominal or small anti-knock resistance beyond that can be controlled by means of water introduction.

2. Description of the Prior Art

Introduction of water or alcohol into the combustion chamber of such engines is a means for reduction of the $NO_x$-emission of internal combustion engines known and tested for a long time. There was already shown repeatedly, that as far as to a predetermined fluid or liquid quantity or volume no negative consequences or effects upon the behavior of the efficiency, effectiveness or output are ascertainable or detectable.

The nitric oxide formation or development during the combustion is determined essentially by the combustion temperature and also can be reduced by the admixing of inert components, ingredients or constituents to the charge. The inert charge components or constituents, corresponding to the specific thermal or calorific capacity or heat-absorption capacity, with fluid or liquid materials additionally corresponding to the heat of vaporization or latent heat of evaporation thereof, can take up a considerable proportion of the heat released during the motor, motive or kinetic process and thus lowering or decreasing the process temperatures.

As methods or procedure for introduction of fluid or liquid with engines driven or operated with fluid or liquid fuels there are known today on the one hand the addition of fluid or liquid to the combustion air supplied to the engine before or ahead of the combustion or operating chamber of the engine and on the other hand there is known the high pressure injection of the fluid or liquid into the combustion chamber. With the first method, which is also called suction-tube addition or manifold injection because of the most frequently employed location of the fluid or liquid addition, the fluid or liquid is injected continuously at a low pressure into the combustion air flow or stream or also is injected intermittently via a central jet or nozzle, or also via several individual jets or nozzles. In order thereby to obtain a homogeneous distribution of the fluid or liquid in the combustion air, the injection jets or nozzles must finely atomize the fluid or liquid. The small jet or nozzle cross sections necessary for doing so bring forth high requirements as to contamination with respect to the preparation of the fluid or liquid to be injected and with water with respect to the hardness of the water. Additionally, there cannot be precluded the partial separation of fluids or liquids on the suction-tube walls with all damaging consequences with the suction-tube addition of fluid or liquid.

With the manifold injection of the fluids or liquids, there is not assured a good atomization of the fluid or liquid because low flow rates or speeds arise or occur during suctioning of the mixture with respect to or giving consideration to the high cylinder filling.

A pre-vaporization of the fluid or liquid and the subsequent admixing to the suction air is connected with problems with respect to an exact dosing of the admixed fluid or liquid quantities or volume. Additionally, there is non-applicable or lost the chance thereby for employment or utilization of the vaporization enthalpy of the fluid or liquid for decreasing or lowering of the process temperature level.

The fluid or liquid medium is injected directly into the combustion chamber by means of a high pressure injection mechanism or equipment with the high pressure injection of fluid or liquid. If the motor is equipped with the Diesel injection system, so the fluid or liquid together with the Diesel fuel can be injected in the form of an emulsion. With that the dosing of the fluid or liquid as well as the production and maintaining of the emulsion must be assured or accounted for by high technical cost. Additionally, there must be provided suitable features or measures to avoid or preclude corrosion damage to the injection system.

Likewise there arises a great cost during utilization, employment or installation of a separate high pressure injection system for the fluid or liquid injection. In each case, there is required also a suitable or adapted preparation of the fluid or liquid also with these methods or procedures.

The known methods for an admixing of a fluid or liquid medium to engines driven or operated with liquid fuels cannot be transferred in a simple manner onto gas engines, since these are provided for especially high service life and all known methods, for example for water admixing, considerably reduce the life expectancy and the disturbance-free operation of the engines. This could not be accepted in view of or with respect to the field of employment of gas engines, so that up to now the employment of the foregoing described introduction of water or alcohol into the combustion chamber on these specific engines was avoided by the experts or average man skilled in the art.

SUMMARY OF THE INVENTION

A basic object of the present invention is to introduce a fluid or liquid into the combustion chamber of internal combustion engines operated with gaseous fuels with a very exact and simple dosing while avoiding the aforementioned disadvantages at a small or nominal apparatus cost. Hereby, the formation or development of a homogeneous distribution of the fluid or liquid in the fresh charge is to be attained by means of an effective atomization of the fluid or liquid during entry or flowing into the working space or chamber without the employment of a high pressure injection system which is too costly, complex, and also susceptible to disturbance.

The object of the present invention is fulfilled thereby that the fluid or liquid is admixed continuously or intermittently to the gaseous fuel and subsequently the power gas, fuel gas/fluid or liquid mixture is blown into the combustion chamber under pressure and atomization of the fluid or liquid. The considerably higher flowing-in or inlet speeds with an opened injection or blowing-in valve compared with the flow speeds during charge change of conventional combustion engines effect a good atomization of the fluid or liquid. Additionally, an ideal spatial allotment or correlation of fuel and liquid or fluid is attained furthermore by the common introduction of the gaseous fuel and the added fluid or liquid in the combustion chamber. Thereby the method of the present invention consequently can be employed advantageously not only for reduction or lowering of the nitric oxide concentration in the engine exhaust gas, but also for suppression of the risk of knock during employment of power gases having a low methane count or number.

There was determined and established advantageously that by employment of media with bound OH-groups there is attained a considerable reduction of nitric oxides in the exhaust gas. According to recognition previously or up to now there is noted that the higher regenerative or recovery rate with respect to the $NO_x$-emission in procedural operation is effective with these media in the sense of advancement or promotion of the desired $NO_x$-reduction. Especially this is true also for the employment of alcohol/water mixtures for which the volume proportions of 45 to 55 volume percent water proportion were ascertained or determined to be especially advantageous. In this range there lies an optimum with respect to attainable $NO_x$-reduction and advantageous fuel gas or power gas consumption.

The water to be fed or supplied as a fluid or liquid medium either alone or in a mixture with alcohols can be advantageously prepared water from the community or municipal water supply network. This further development of the present invention is advantageously noticed most of all with the stationary employment of the internal combustion engine, since according to the object which is the basis of the present invention it is not necessary and provision is not made to operate with a high pressure injection system. The community or municipal water pressure is sufficient so that a considerable savings of apparatus or structural parts is attainable. The fluid or liquid supply pressure is kept advantageously above the supply pressure of the gas or fuel supply.

The alcohol employed as a fluid or liquid medium encompasses conceivably or conceptually different degrees of purity, especially also the raw or crude methanol not always identically composed or compounded because of the production circumstances and employed materials.

According to an expedient and purposeful development or refinement according to the present invention, the control or regulation of the fluid or liquid quantity to be admixed to the gaseous fuel is undertaken dependent upon the momentary gas consumption and/or a characteristic construction unit temperature and/or especially dependent upon a signal for detection of the knock intensity. These influencing parameters can be taken or relied upon individually or in combination of several for control or regulation.

It is further expedient or purposeful that according to a further improvement of the present invention that the setting or adjustment of the fluid or liquid through-passage ascertained or determined from the control, regulation, standard or normal sizes is undertaken through the opening duration of the fluid or liquid supply with cyclic or rhythmic control or regulation and/or by the pressure difference between the fluid or liquid system and the gas system and/or by throttling in the fluid or liquid supply.

Thereby the fluid or liquid supply is interrupted with standing, running-out or non-operatively warm internal combustion engines to avoid motor damage as a consequence of corrosion or fluid or liquid shock or impact, whereby during turning-off in a follow-up control or remote control first the fluid or liquid supply and subsequently after a definite time the motor or engine itself is turned off.

The apparatus according to the present invention for performing and carrying out the aforementioned method is characterized thereby that in the gas-supply tube or pipe in the flow direction shortly before an inlet valve there is arranged a dosing tube or pipe for supplying of fluid or liquid medium. Preferably the valve provides a cylindrical profiling in the seat region. Thereby there is attained that the fluid or liquid introduced or stored before the closed valve is blown along therewith by gas upon opening of the valve into the combustion chamber, whereby via the cylindrical profiling in the seat region during the opening first only a narrow, annular or ring-shaped gap is made free or released. The high gas inflow speeds resulting therefrom effect or bring about that the fluid or liquid introduced or stored before the valve is finely atomized. This effect makes possible a rapid complete vaporization of the blown-in fluid or liquid, especially as to the water.

In an expedient, practical appropriate or useful manner there is noted that an adjustable pressure reduction, a magnetic shut-off valve for interruption of the fluid or liquid supply dependent upon a safety control unit, a control or regulator valve for control or regulation of the added fluid or liquid quantity or volume dependent upon a control unit and a check valve are arranged sequentially or one after another in the flow direction in a supply line to the dosing tube or pipe. A pressure- or acceleration pick-up or detector can be arranged or associated with the control or regulation unit for detection of knock intensity. The regulator or control valve itself can be embodied as an adjustable throttle with continuous fluid or liquid supply or as a cycled valve with intermittent fluid or liquid supply. Finally, it is advantageous to employ a differential pressure regulator as a pressure reducer.

A simple or straightforward dosed introduction of fluids or liquids into the working or operating chamber of internal combustion engines operated with gaseous fuels is made possible with the features of the present invention as described. With that the fluid or liquid together with the fuel gas under pressure is blow-in through a valve into the working or operating space or chamber. The resulting ideal spatial association or relationship of fuel or combustion gas and liquid or fluid effects an optimum utilization or exploitation of the fluid or liquid for reduction or decrease of the $NO_x$-emission and suppression of the risk of knock.

Because of the high flow speeds existing in the narrow valve gap that opens, there is noted that the blown-in fluid or liquid is well atomized. Consequently, no special requirements are made as to the fluid or liquid supply with respect to the atomization thereof. Preparation of the employed fluid or liquid for reduction of the contamination and—with employment or utilization of water—the water hardness, compared with the requirements with direct fluid or liquid injection, can be less costly or less complex.

The gas-blow-in pressures conventional with present day internal combustion engines with gas-blowing in permit the pressure level of community or municipal water supply networks to appear as sufficient for introduction of sufficient water quantities or volume.

Further individual characteristics, features and advantages of the present invention will be apparent from the following description which refers to the schematic illustrations therewith.

BRIEF DESCRIPTION OF THE DRAWINGS

This object, and other objects and advantages of the present invention, will appear more clearly from the following specification in connection with the accompanying drawings, in which.

DETAILED DESCRIPTION

Figure 1:
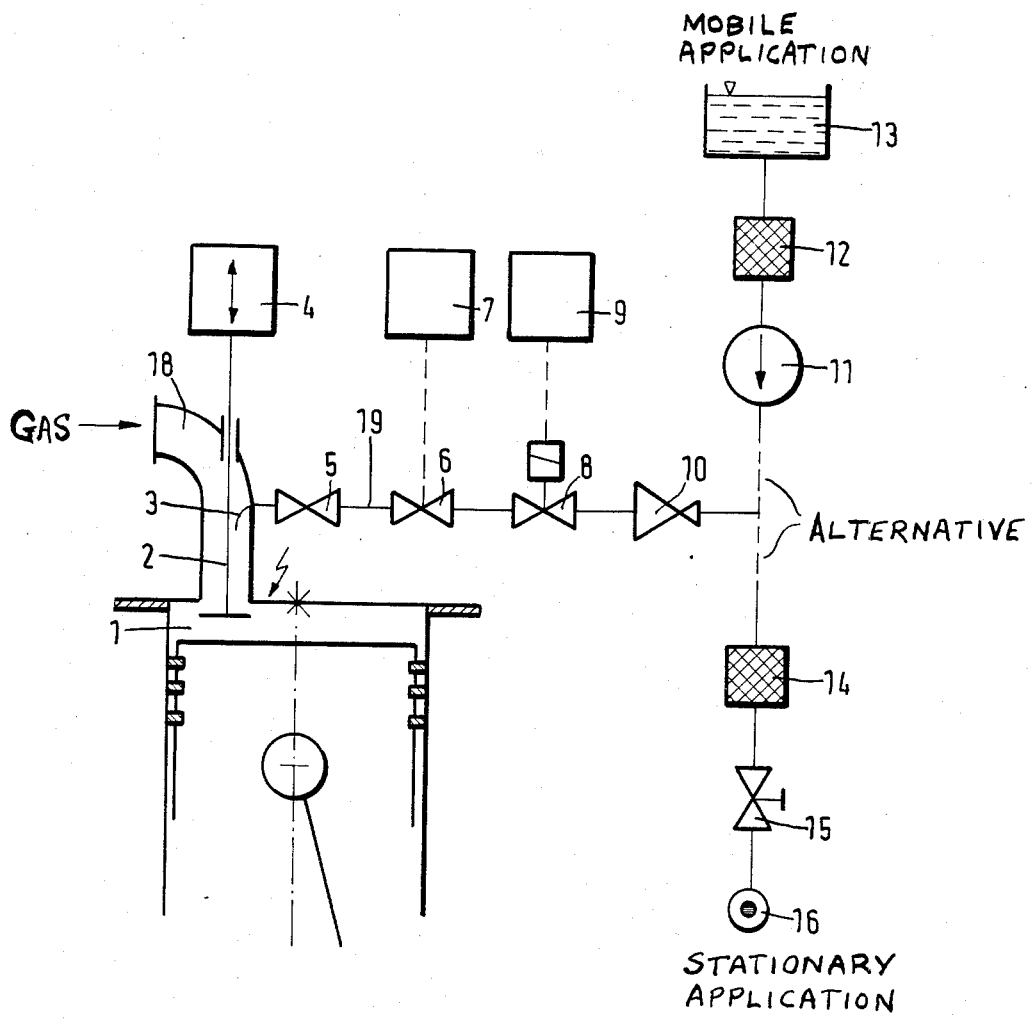
FIG. 1 illustrates a specific embodiment of an apparatus for introduction of water into the working or operating chamber of a stroke-piston internal combustion engine in a schematic manner.
Figure 2:
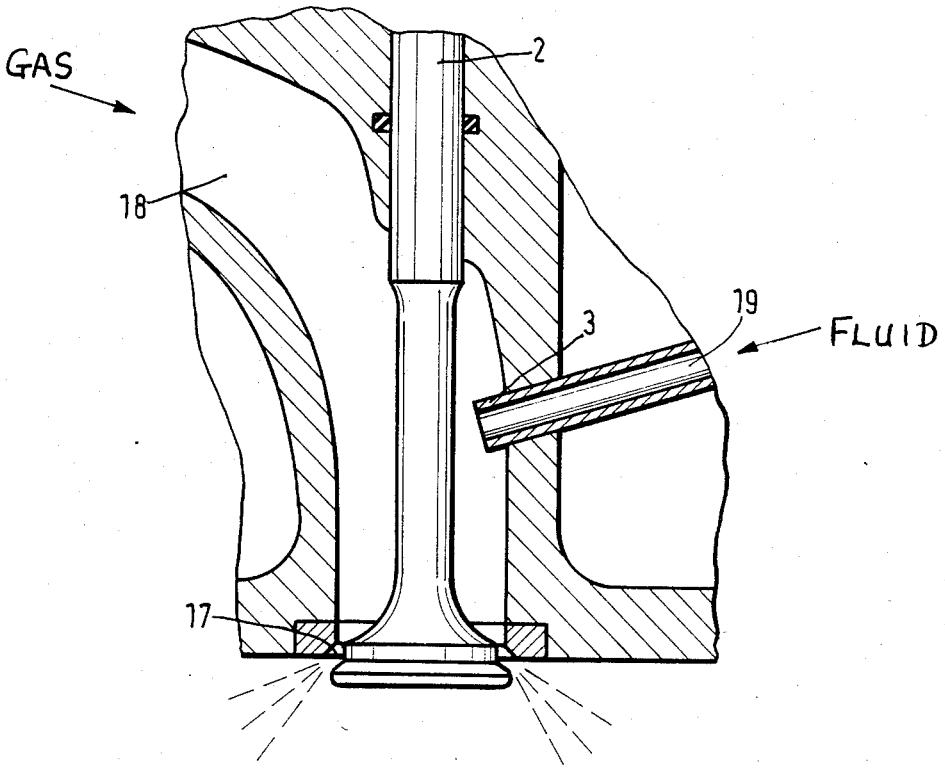
FIG. 2 is a section of the foregoing taken through a charging or blowing-in valve therewith.

FIG. 1 of the drawing schematically illustrates and shows a combustion chamber 1 with a piston of an internal combustion engine arranged therebelow as recognizable to which a gas-supply pipe or tube 18 is connected for a power or fuel gas. A charging or blowing-in valve 2 is arranged for control or regulation of the supply or access at the transition from the tube 18 to the combustion chamber 1, which according to FIG. 2 of the drawing provides a cylindrical profiling 17 in the seat region in such a manner that upon opening only a narrow, annular or ring-shaped gap is made free or released.

A supply line or conduit 19 for water in the pipe or tube 18 via a dosing tube or pipe 3 opens closely above the valve 2 so that it is possible to feed or convey fluid or liquid water directly ahead of or before the valve 2. The still inhomogeneous gas-water-mixture before the valve 2 is blown-into the combustion chamber 1 under the pressure of the gas supply network of the engine upon opening of the valve, which is actuated by a suitable valve control 4. The high-gas-flow-in speeds resulting via the annular gap at the valve seat effect or bring about that the fluid or liquid water stored before using or introduction as to the valve 2 is finely atomized. There occurs and results a rapid, complete vaporization of the water blown into the combustion chamber 1.

For regulation and control of the procedure of water admixing, there are arranged sequentially or one after the other in the supply or feed line 19 the components including a check valve 5, a regulator or control valve 6 actuated by a control unit 7, a magnetic shut-off valve 8 actuated by a safety control unit 9 and a pressure reducer or pressure-reducing valve 10, whereby the further connection to the feed or supply line 19 at two alternatively illustrated water supply possibilities illustrated or made evident by dashes in FIG. 1 of the drawing.

From the alternative illustration there is ascertainable that the water to be added with stationary employment or utilization of the motor or engine can be taken or removed directly from a water supply network 16 via a shut-off valve 15 and a filter 14 or with a mobile utilization or employment there is noted that the added water can be taken or removed from a water storage container 13 via a filter 12 by means of a conveying or feed pump 11. The pressure-reducing valve or pressure reducer 10 holds or maintains the water supply pressure at a constant value which lies above the supply pressure of the supply or delivery of gas. The pressure-reducing valve or pressure reducer 10 is constructed as a differential pressure regulator with variable or changing gas pressure.

The post-connected magnet-shut-off valve 8 serves for interruption of water supply and is opened by a safety control unit 9 only during working or running and under hot running condition of the engine or motor. Upon shutting-off of the engine or motor, a sequence switch integrated into the safety control valve 9 during shutting off of the motor first switches off the water supply and then after a selected or defined time shuts off the motor or engine. With that the fluid or liquid deposits in the motor or engine with all damaging consequences are avoided. The abovementioned sequence switch however has no function with an emergency-stop-actuation.

The regulator or control valve 6 serves for control or regulation of the added water quantity or volume. The control valve 6 can be constructed as an adjustable throttle with continuous water supply or as a cycled, timed or rhythmic valve with intermittent water supply. The correspondingly matched or adapted control unit 7 adjusts or sets the water throughflow dependent upon one or also several standard or normal sizes or magnitudes. Hereby, for example there can be drawn upon a characteristic structural member temperature, the setting or adjustment of a power or output adjustment member (throttle flap, control rod) or the signal of a measuring chain or calibrated phase changer employed for detection or determination of knock intensity for regulation or control purposes.

A further possibility for control of the water through-passage consists therein to be effective with the control unit 7 upon an adjustably embodied pressure reducing valve or pressure reducer 10 as an adjustment member and to control the water through passage by means of variation or changing of the pressure difference between the water- and gas reservoir.

The safety-check valve 5 is installed directly before the dosing pipe or tube 3 and prevents the discharge or streaming-out of gas into the water system during absence of the necessary or required water supply pressure.

In place of the water employed as a fluid or liquid medium in the aforementioned specific embodiment of the invention, there can be introduced alcohols, alcohol mixtures or alcohol/water mixtures into the combustion chamber 1 of the gas engine subject to utilization or employment of the same apparatus. The following test readings or results of measurements were obtained for $NO_x$-emission with equal or identical efficiency (consumption) on a stationary, single-cylinder-two-cycle engine operated with gas as a percentage to the actual original datum or output value, which represents the motor or engine operation without addition of a fluid or liquid medium.

EXAMPLE 1

Addition of water
Quantity: 85 g/kWh$_{mech}$ relative reduction of $NO_x$-emission: 40%

EXAMPLE 2

Addition of pure methanol
Quantity: 330 g/kWH$_{mech}$
relative reduction of $NO_x$-emission: 50%

EXAMPLE 3

Addition of a methanol/water-mixture with 50% volume percentage water proportion
Quantity of Methanol: 115 g/kWh$_{mech}$
Quantity of Water: 145 g/kWh$_{mech}$
Relative reduction of $NO_x$-emission: 70%

In a range between 45 and 55 volume percentage water proportion in methanol/water-mixture there were attained substantially equal or identical percentage $NO_x$-reductions.

Subject to making allowance for or subject to acceptance of smaller or more nominal $NO_x$-reductions there can be attained also considerable reductions in consumption of power gas or efficiency improvements with application and employment of the teaching of the present invention.

The present invention is, of course, in no way restricted to the specific disclosure of the specification and drawings, but also encompasses any modifications within the scope of the appended claims.

What we claim is:

1. A method for introduction of the fluid medium into a working combustion chamber of an internal combustion engine operated with gaseous fuels including a power gas rather than liquid fuel, comprising the steps of admixing the fluid medium to the gaseous fuel alone before combustion procedure at least intermittently whereby feeding of air supply occurs separately in the combustion chamber, then thereafter blowing-in a power-gas/fluid medium mixture combined therewith specifically during inner mixture formation in the working combustion chamber, said flowing-in occurring under the pressure of the power gas for reduction of $NO_x$-emission; and providing bound OH-groups in the fluid medium being admixed to the gaseous fuel, the fluid medium being selected from a group including water, alcohol and also employing alcohol/water mixtures as the fluid medium.

2. A method according to claim 1 wherein the said employing of alcohol/water mixture includes a water proportion of 30 to 70 volume percentage.

3. A method according to claim 1 wherein there is provided an alcohol/water mixture specifically in a range of 45 to 55 volume percentage water proportion.

4. A method according to claim 1 including the step of employing water refined as fluid medium being taken from the community water supply network.

5. A method according to claim 1 which includes employing fluid medium used in the form of alcohol having impurities determined by production thereof.

6. A method according to claim 5 in which the providing of fluid medium in the form of alcohol includes using crude methanol.

7. A method according to claim 1 comprising the step of regulating the fluid volume being admixed to the gaseous fuel by regulation of said fluid volume at least dependent upon momentary gas consumption, dependent upon a characteristic structural member temperature, particularly dependent upon a signal for detecting of knock intensity therewith.

8. A method according to claim 1 comprising the steps of undertaking the regulating of fluid through-passage obtained from magnitudes of at least one from a group of operating conditions including the opening duration of the fluid supply with cycled regulation, by the pressure difference between the fluid- and gas system, by throttling of the fluid supply.

9. A method according to claim 1 including the step of interrupting fluid supply with standing, running-out as well as non-operationally warm internal combustion engines, whereby there is first a shutting-off of the fluid supply upon turning-off in a sequence regulation and subsequently after a predetermined defined time there is turning-off of the engine itself.

10. A method according to claim 1 including a step of maintaining fluid supply pressure above the supply pressure of gas supply.

11. An apparatus to introduce fluid medium into a working combustion chamber of an internal combustion engine operated with gaseous fuel including a power gas rather than liquid fuel subject to admixing of fluid medium to the gaseous fuel alone before combustion procedure at least intermittently whereby feeding of air supply occurs separately in the combustion chamber and then thereafter the power gas/fluid medium mixture combined is blown therewith specifically during inner mixture formation in the working combustion chamber under the pressure of the power gas for reduction of $NO_x$-emission via an arrangement comprising an inlet valve including a cylindrical configuration in a seat region of said inlet valve as well as a gas supply pipe having a flow direction therein, and a dosing tube arranged for feeding and supplying of the fluid medium into the gas supply tube in flow direction shortly before said inlet valve.

12. An apparatus according to claim 1 which further includes a supply line to the dosing tube in flow direction having in sequence one after another therewith an adjustable pressure reducing valve, a magnetic shut off valve for interruption of the fluid supply dependent upon a safety regulation unit, a regulator valve for regulation of the fluid quantity to be added dependent upon said regulation unit and a check valve therewith.

13. An apparatus according to claim 12 wherein said regulation unit is regulated by a signal of a measuring chain calibrated-phase-changer receiving and detecting at least one of conditions including pressure and acceleration as well as being installed for detection of knock intensity.

14. An apparatus according to claim 12 in which said regulator valve is constructed as an adjustable throttle with continuous fluid supply.

15. An apparatus according to claim 12 with which said regulator valve is constructed as a cycled valve with intermittent fluid supply.

16. An apparatus according to claim 12 in which said pressure reducing valve is a differential pressure regulator.

* * * * *